US008998014B2

(12) United States Patent
Iwasaki

(10) Patent No.: US 8,998,014 B2
(45) Date of Patent: Apr. 7, 2015

(54) LID AND CONTAINER PROVIDED THEREWITH

(71) Applicant: Yoshihisa Iwasaki, Yamatokooriyama (JP)

(72) Inventor: Yoshihisa Iwasaki, Yamatokooriyama (JP)

(73) Assignee: Iwasaki Industry Inc. (JP)

( * ) Notice: Subject to any disclaimer, the term of this patent is extended or adjusted under 35 U.S.C. 154(b) by 51 days.

(21) Appl. No.: 13/766,185

(22) Filed: Feb. 13, 2013

(65) Prior Publication Data

US 2014/0224799 A1 Aug. 14, 2014

(51) Int. Cl.

| | |
|---|---|
| ***B65D 51/18*** | (2006.01) |
| ***B65D 43/14*** | (2006.01) |
| ***B65D 51/16*** | (2006.01) |
| ***A45C 11/20*** | (2006.01) |
| ***B65D 45/22*** | (2006.01) |
| ***A45C 13/00*** | (2006.01) |

(52) U.S. Cl.

CPC ..... *B65D 51/1683* (2013.01); *A45C 11/20* (2013.01); *B65D 45/22* (2013.01); *A45C 13/008* (2013.01)

(58) Field of Classification Search

CPC ..... B65D 51/1683; B65D 2205/00

USPC ..... 220/254.3, 367.1, 368, 373, 203.1, 231, 220/203.11, 840, 254.1, 244, 80, 5, 714; 219/735, 725; 215/260, 262, 50, 54, 215/299

See application file for complete search history.

(56) References Cited

U.S. PATENT DOCUMENTS

| | | | | |
|---|---|---|---|---|
| 5,054,640 | A * | 10/1991 | Tucker | 220/716 |
| 5,636,978 | A * | 6/1997 | Sasaki | 431/69 |
| 5,762,228 | A * | 6/1998 | Morgan et al. | 220/367.1 |
| 6,053,474 | A * | 4/2000 | Stucke, Jr. et al. | 251/299 |
| 6,679,403 | B2 * | 1/2004 | Goodall et al. | 222/481.5 |
| 7,387,220 | B2 * | 6/2008 | Verespej et al. | 222/153.01 |
| 8,292,103 | B2 * | 10/2012 | Weist | 215/252 |
| 8,729,438 | B2 * | 5/2014 | Iwasaki | 219/735 |

FOREIGN PATENT DOCUMENTS

JP 2004113776 A 4/2004

* cited by examiner

*Primary Examiner* — Robert J Hicks
*Assistant Examiner* — Shawn M Braden
(74) *Attorney, Agent, or Firm* — St. Onge Steward Johnston & Reens LLC

(57) ABSTRACT

A resin lid for a container body with an opening in an upper part, including a body part that closes the opening and has an air hole, and a flap that includes a base, a hinge on a first end of the base, and a projection provided on a second end side of the base and fitted in the air hole. The flap is swingable around the hinge between a first position in which the projection fits in the air hole and a second position in which the air hole is open. The body part and flap are integrally formed. When the flap travels from the second to the first position, a tip of the projection comes into contact with a circumferential edge of the opening of the air hole on a side opposite the hinge, and the projection fits in the air hole as the flap elastically deforms.

6 Claims, 10 Drawing Sheets

(a)

(b)

(c)

LID AND CONTAINER PROVIDED THEREWITH

FIELD OF THE INVENTION

The present invention relates to a lid and a container provided with the lid.

BACKGROUND OF THE INVENTION

Heretofore, various containers for sealing food have been proposed. For example, JP 2004-113776A discloses a container that includes a container body having an opening in the upper part and a lid attached to the container body for sealing. The lid of this container is provided with a swingable flap, and the container is configured to be capable of opening or closing the air hole formed in the lid by the flap. More specifically, the projection provided on the lower surface of the flap is fitted in the air hole to attain an airtight state, and the flap is lifted upright to remove the projection from the air hole, thus making it possible to introduce air into the container. Accordingly, closing the air hole by the flap makes it possible to seal the container, and on the other hand, operating the flap to open the air hole makes it possible to, for example, suitably release the steam inside the container through the air hole when heating food in a microwave oven. In this container, a circular gasket is attached to the projection to enhance the adhesion between the projection and the air hole.

Meanwhile, attachment of a circular gasket to the projection as described above is problematic in that it results in an increased number of components although the adhesion between the projection and the air hole is enhanced. In addition, it is also problematic in that the container cannot be sealed if the gasket is detached and lost. Accordingly, it is possible to consider fitting the projection in the air hole without using a gasket. However, it is not easy to precisely adhere the projection to the air hole if the flap and the lid are integrally formed. For example, if adhesion is poor, not only can the container not be sealed but also the projection may be easily detached from the air hole. Such problems are applicable to not only food containers but also containers in general that need to be brought into an airtight state and an aerated state.

Accordingly, the present invention has been conceived in view of the foregoing problems, and an object of the present invention is to provide a lid that can secure adhesion between the projection and the air hole even when the flap is integrally formed, and a container provided with the lid.

SUMMARY OF THE INVENTION

The present invention is a lid for attachment to a container body that has an opening in an upper part, including a body part that closes the opening of the container body and has an air hole for communication with the inside of the container body, and a flap that includes a base, a hinge that is provided on a first end of the base and connected to the body part, and a projection that is provided on a second end side of the base and fitted in the air hole so as to be capable of sealing the air hole, and is configured to be swingable around the hinge between a first position in which the projection fits in the air hole and a second position in which the air hole is open, wherein the body part and the flap are integrally formed from resin, and when the flap travels from the second position to the first position, at least part of a tip of the projection comes into contact with a circumferential edge of the opening of the air hole on a side opposite the hinge, and then the projection fits in the air hole as the flap elastically deforms.

According to this configuration, when the flap travels from the second position to the first position, the projection comes into contact with the circumferential edge of the opening of the air hole on the side opposite the hinge, and then the projection fits in the air hole as the flap elastically deforms. Therefore, the projection can be fitted in the air hole while elastic force acts thereon. It is thus possible to enhance adhesion between the air hole and the projection. In particular, the air hole and the projection aligned as described above are advantageous in that adhesion that takes advantage of elastic force can be obtained in addition to adhesion that is attained by adjusting the outer diameter of the air hole and the inner diameter of the projection. Note that the elastic deformation of the flap herein means that elastic deformation occurs in any portion of the flap. That is, the projection may be configured to fit in the air hole due to the deflection of at least one of the base, hinge, and projection. The second position of the flap is not particularly limited and refers to any state in which the projection is detached from the air hole, and the flap may be at any angle within the extent of swinging of the flap. The phrase "tip of the projection" encompasses the tip surface and a portion around the tip surface, and also the phrase "circumferential edge part of the opening of the air hole" encompasses the circumferential edge of the opening and the inner wall of the opening.

For example, the projection can be formed such that the diameter becomes smaller from the flap toward the tip side. Accordingly, the space between the projection and the air hole decreases as the projection enters the air hole, and the projection can fit in the air hole eventually without any space therebetween. Thus, the projection easily enters the air hole, and a dimensional error is cancelled, thus making it possible to enhance adhesion.

The lid may be configured such that the flap is further provided with a first latch that is attached to the second end side of the base, the body part is further provided with a second latching part that can engage with a portion of the first latching part facing the hinge side, and the first latching part and the second latching part engage when the flap is in the first position. Accordingly, the first latching part and the second latching part engage when the flap is in the first position, thus making it possible to retain the flap in the first position and prevent the projection from being unintentionally detached from the air hole. When the flap travels from the second position to the first position, the projection moves toward the hinge side, accompanying elastic deformation of the flap, and thus the base of the flap is pulled toward the hinge side. At this time, since the second latch and the portion of the first latching part facing the hinge side are engaged, the base that is being pulled causes the latching parts to be more tightly engaged. As a result, the latching parts reach a firmly engaged state, thus making it possible to more strongly retain the flap in the first position.

The flap may be further provided with at least one first rib that extends from the first end side toward the second end side of the base. This configuration provides the following advantages. Generally, resin molding may result in a warped product. Alignment of the projection and the air hole is important in the present invention, and for example, a warped flap can result in the problem that the relative positions of the projection and the air hole do not match, and the projection does not come into contact with the circumferential edge of the opening of the air hole before the flap reaches the first position. Accordingly, providing the base of the flap with a first rib as described above makes it possible to prevent warpage of the flap. As a result, the projection and the air hole can be precisely aligned.

In the lid, the second end side of the base of the flap may be rounded, and the base may be provided with a second rib that extends in a second direction that is perpendicular to a first direction extending from the first end toward the second end, at a predetermined distance away from the second end toward the first end side. Providing such a rib can reinforce the flap and prevents warpage. Also, disposing the second rib at a predetermined distance away from the rounded end of the base makes it possible to prevent the second rib from becoming obstructive when lifting the flap upright by placing the fingers on the second end of the base.

The container according to the present invention is provided with a container body that has an opening in the upper part and the above-described lid for attachment to the container body. The container used here is not particularly limited, for example, a resin product, glassware, etc. can be used.

According to the present invention, adhesion between the projection and the inner wall surface of the air hole can be enhanced.

DETAILED DESCRIPTION OF THE INVENTION

Figure 4:
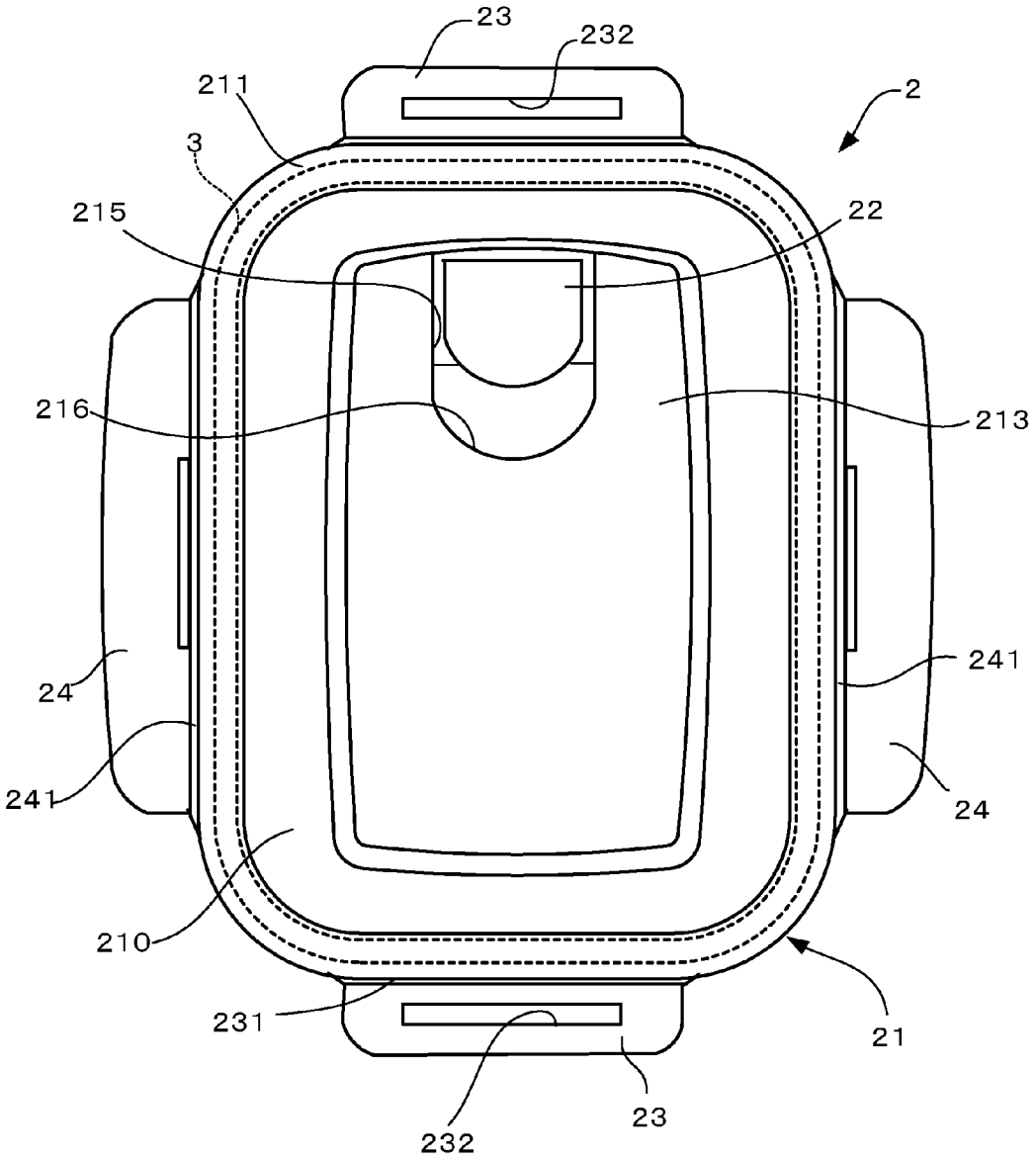
FIG. 4 is a plan view of a lid.

Below, an embodiment of the present invention applied to a lid and an airtight container for accommodating food will now be described with reference to the drawings. Note that in the description below, the right-left direction of FIG. 4 will be referred to as the width direction, and the top-bottom direction will be referred to as the longitudinal direction. Also, the upper side of FIG. 4 is referred to as a first end (one end) side, and the lower side is referred to as a second end (the other end) side. These apply to the other drawings as well.

Figure 1:
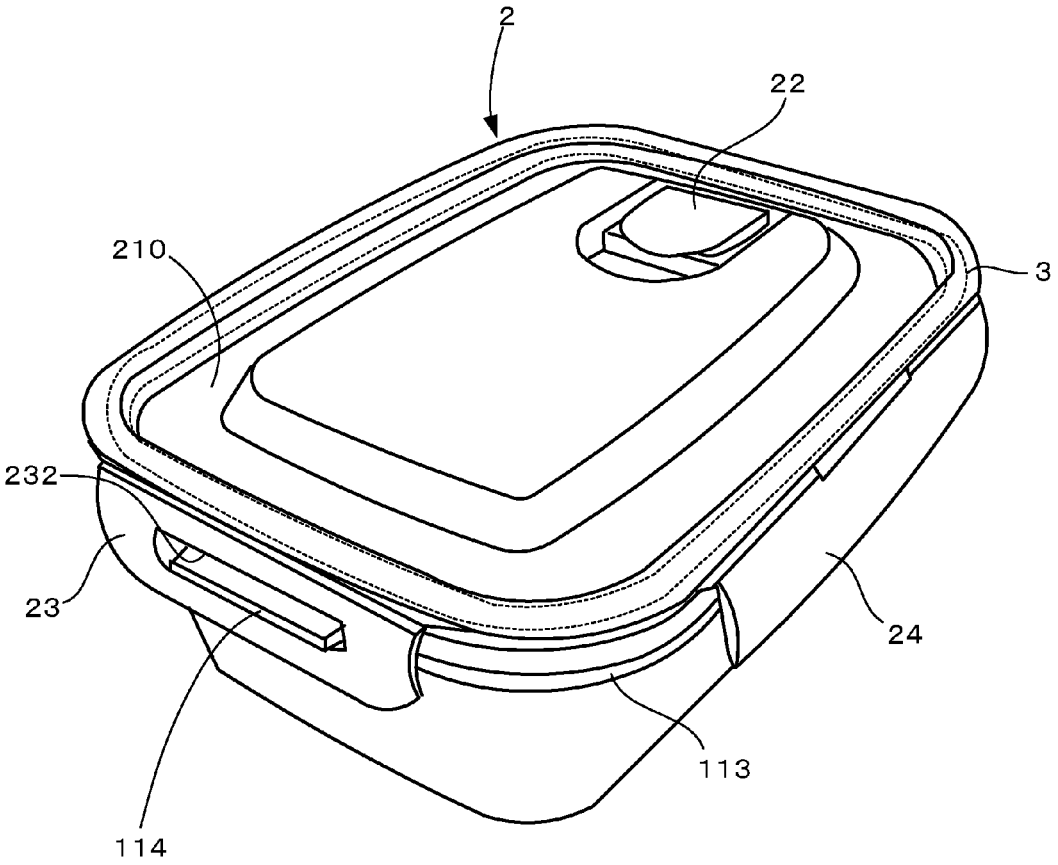
FIG. 1 is a perspective view showing one embodiment of a container according to the present invention.

FIG. 1 is a perspective view of a container according to one embodiment. As shown in FIG. 1, the container of this embodiment is configured with a container body 1 that has an opening in the upper part, a lid 2 that covers the opening in the upper part of the container body 1, and a sealing member 3 for fixing the container body 1 and the lid 2 so as to be liquid-tight. Below, these components will now be described in detail.

1. Container Body

Figure 2:
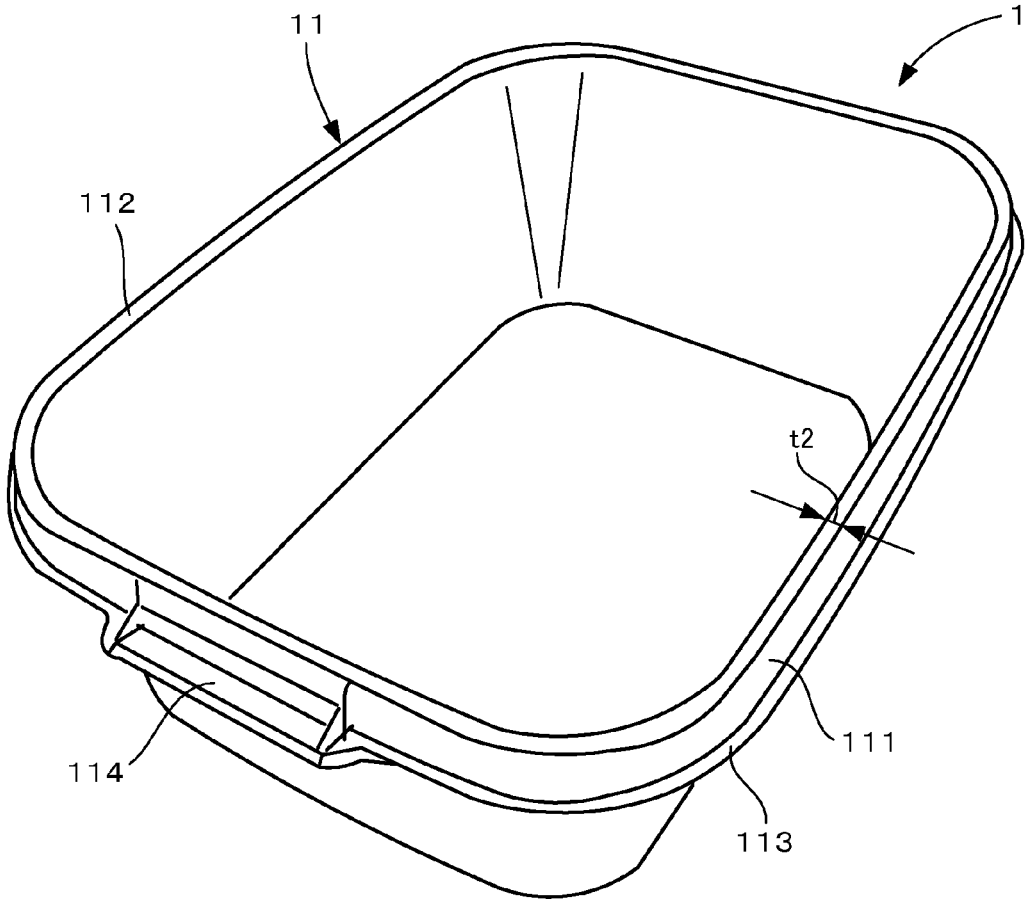
FIG. 2 is a perspective view of a container body.
Figure 3:
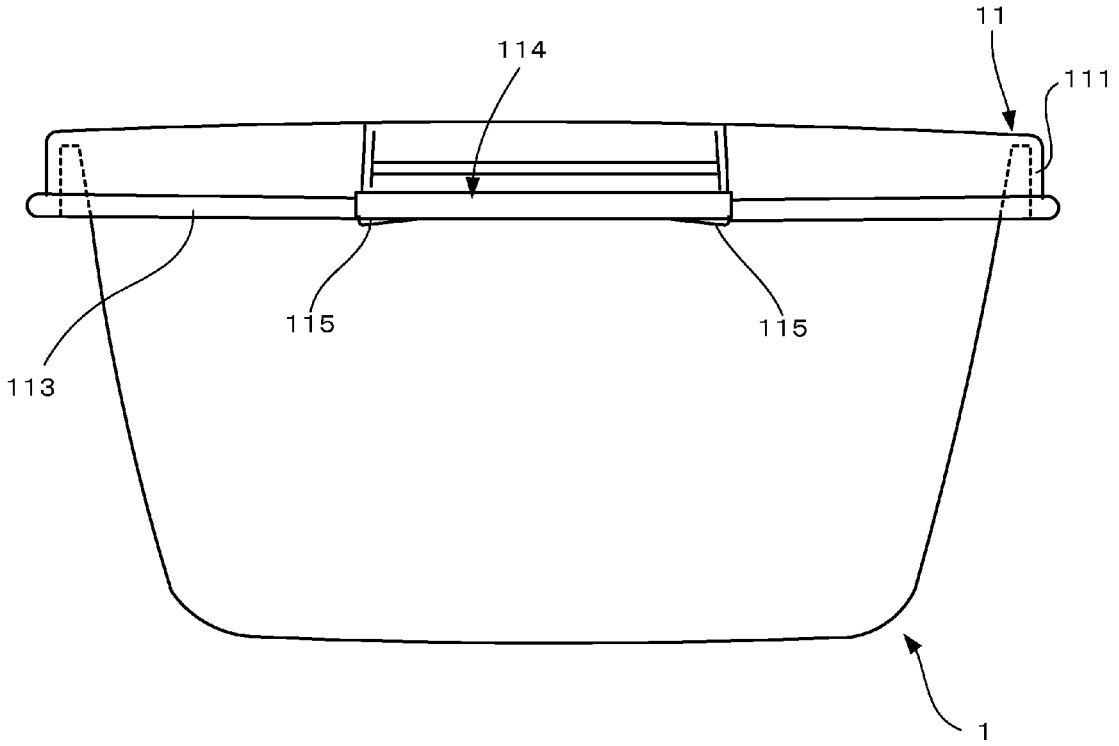
FIG. 3 is a front view of the container body.

FIG. 2 is a perspective view of the container body, and FIG. 3 is a front view of the container body. As shown in FIGS. 2 and 3, the container body 1 is integrally molded from resin, and is formed in a cuboidal shape having an opening in the upper part. An upper end 11 of the container body 1 is formed in a rectangular shape as viewed from above, with the four corners being rounded, and is provided with a roll-back part 111 that is folded outward. Accordingly, the upper end of the container body 1 has a cross-section that is an inverted U shape and an upper end surface 112 that is flat. The lower end of the roll-back part 111 is provided with a flange 113 that projects outward in the horizontal direction. Also, each end in the longitudinal direction is provided with a grip 114 that projects from the roll-back part 111 more outward than the flange 113. Each grip 114 is formed in a plate shape extending in the width direction, and each end of the lower surface of the grip 114 is provided with projections 115 that project downward. The resin that constitutes the container body 1 is not particularly limited as long as it has heat resistance and is elastically deformable, and for example, polypropylene, saturated polyester, and the like can be used.

2. Lid

Figure 5:
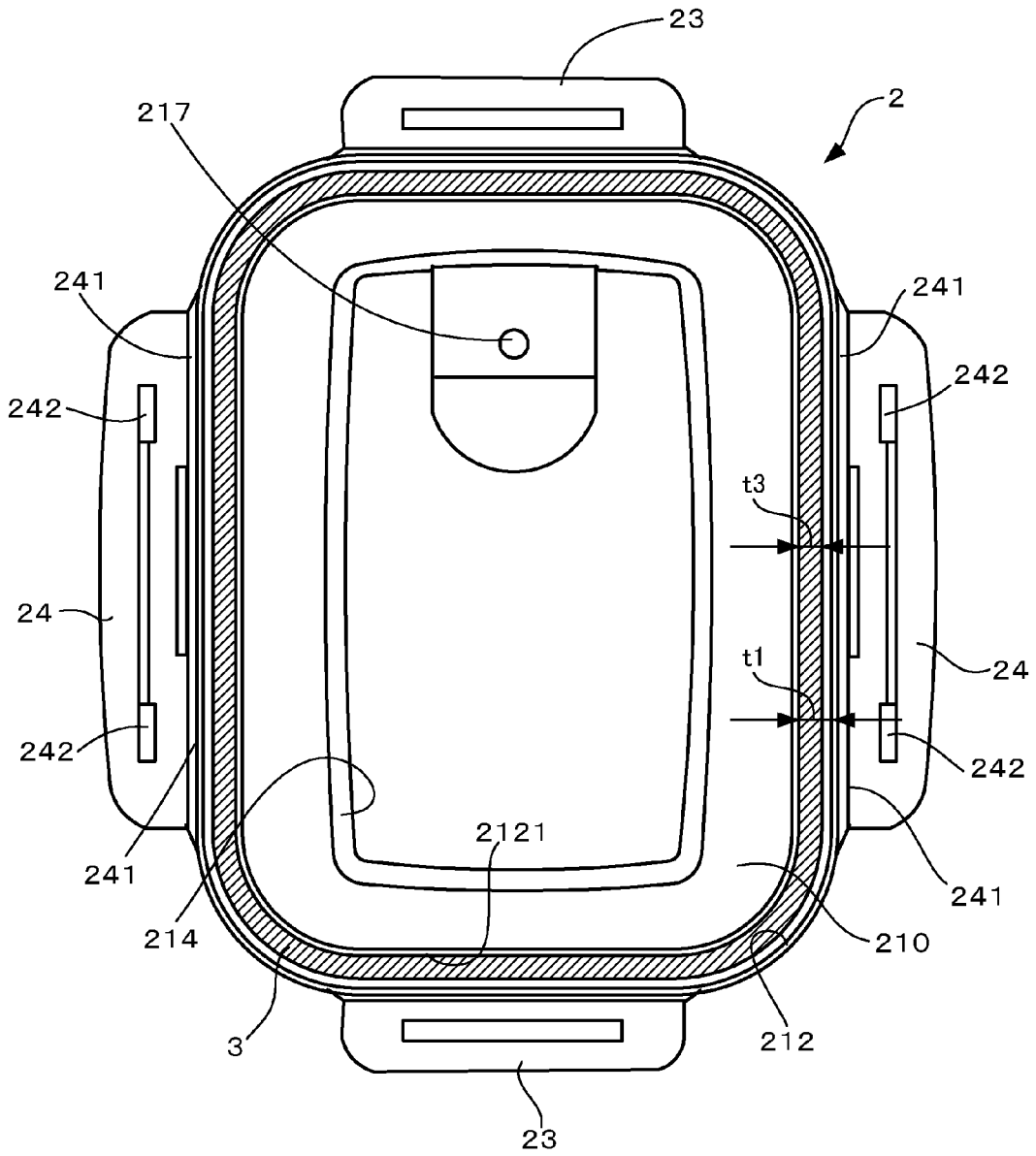
FIG. 5 is a bottom view of the lid.
Figure 6:
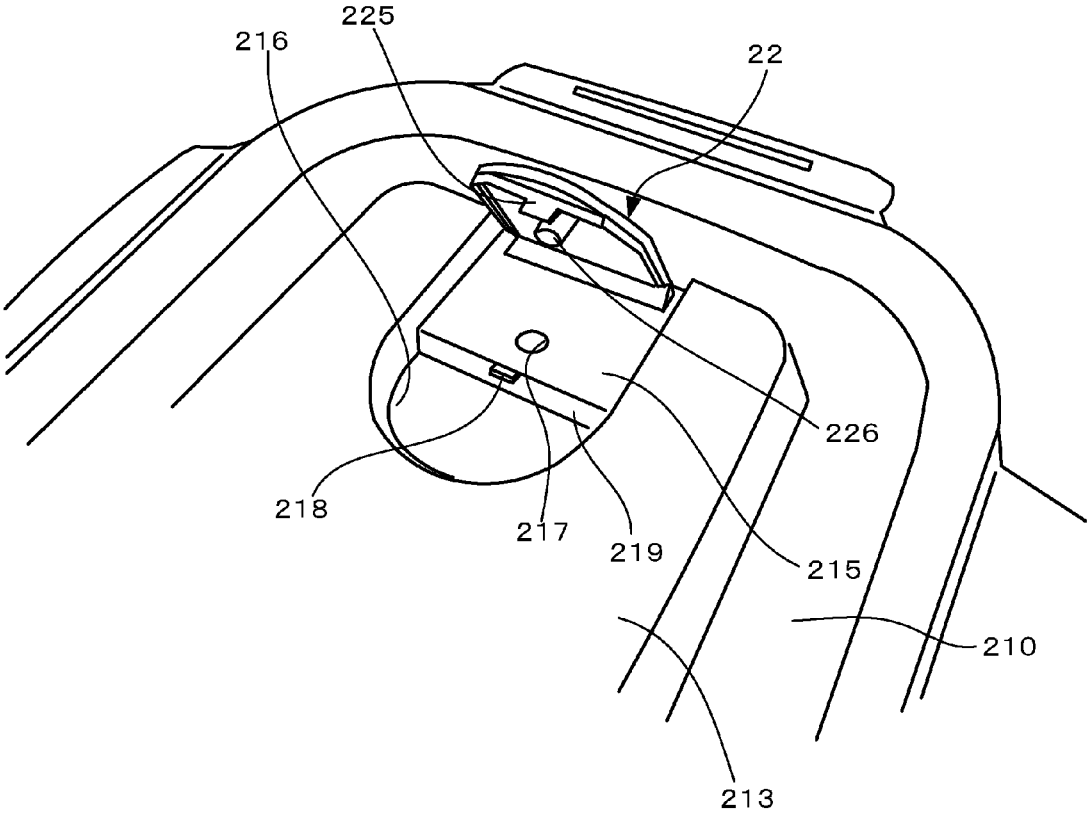
FIG. 6 is an enlarged perspective view showing a flap in an open state.

FIG. 4 is a plan view of the lid, FIG. 5 is a bottom view of the lid, and FIG. 6 is an enlarged perspective view showing a flap in an open state. As shown in FIGS. 4 and 5, the lid 2 is provided with a flat body part 21 and a flap 22 that has a plate shape and is disposed on the upper surface of the body part 21. Each end in the longitudinal direction of the body part 21 is provided with a first clasp 23 for fixing to the container body 1, and each end in the width direction of the body part 21 is provided with a second clasp 24 for fixing to the container body 1. The body part 21, flap 22, and clasps 23 and 24 are integrally formed from resin. The resin used here is not particularly limited, and the same material as the container body 1 may be used.

The body part 21 is formed in a rectangular shape as viewed from above, with the four corners being rounded. The circumferential edge of the upper surface of the body part 21 is provided with a circular circumferential bulge 211, and the circumferential edge of the lower surface of the body part 21 is provided with a circular circumferential groove 212 in the corresponding manner. The circumferential groove 212 is configured to receive the upper end surface 112 of the container body 1, and a width t1 of the circumferential groove 212 is therefore greater than a width t2 of the upper end surface 112. The sealing member 3 composed of a hollow O ring is fitted to the circumferential groove 212. The sealing member 3 is formed in a circular shape, and the natural length of the inner circumference thereof is smaller than the inner circumference of the circumferential groove 212. Therefore, when fitting the sealing member 3 to the circumferential groove 212, the sealing member 3 needs to be elastically stretched and fitted to the circumferential groove 212. Thereby, the sealing member 3 is retained in the circumferential groove 212 by the elastic force. The width t1 of the circumferential groove 212 is greater than a width t3 of the sealing member 3. Accordingly, when the sealing member 3 is attached to the circumferential groove 212, there is a small gap formed between the sealing member 3 and the inner wall surface on the outer side of the circumferential groove 212. Moreover, an inner wall surface 2121 on the inner side of the circumferential groove 212 is inclined outward from the upper part to the lower part. This inclination of the inner wall surface 2121 serves as a retaining means that prevents the sealing member 3 from being detached from the circumferential groove 212. It is preferable that the width t1 of the circumferential groove 212 is about 1.1 to about 1.3 times greater than the width t2 of the upper end surface 112 of the container body 1 and the width t3 of the sealing member 3.

A rectangular central bulge 213 is formed in the center of the upper surface of the body part 21 at a specific distance from the circumferential bulge 211, and a rectangular central depression 214 is formed in the lower surface of the body part 21 in the corresponding manner. Accordingly, a flat base 210 is formed between the circumferential bulge 211 and the central bulge 213. As shown in FIG. 6, the central bulge 213 is provided with a rectangular first depression 215 that extends from the first end in the longitudinal direction toward the second end side, and the flap 22 is accommodated in the first depression 215. A circular air hole 217 that penetrates through the body part 21 is formed on the second end side of the first depression 215. The depth of the first depression 215 is smaller than the height of the central bulge 213 and is nearly the same as the thickness of the flap 22, and as will be described below, the upper surface of the flap 22 and the upper surface of the central bulge 213 are configured to be on nearly the same plane when the flap 22 is closed. A second depression 216 that has a semicircular shape as viewed from above and has the same width as the first depression 215 is connected to the tip, i.e., the second end side, of the first depression 215. The second depression 216 is deeper than the first depression 215, and thus a step 219 is formed at the border between the first depression 215 and the second depression 216. However, the depth of the second depression 216 is smaller than the height of the central bulge 2, and thus the bottom surface of the second depression 216 is located higher than the base 210 (see FIG. 7). Therefore, for example, when placing a plurality of lids 2 one on top of the other, the bottom surface of the second depression 216 does not interfere, and the bottom surface of the base 210 projecting downward between the circumferential groove 212 and the central depression 214 fits between the central bulge 213 and the circumferential bulge 211 of the lid disposed below, and the positions of the lids located above and below are mutually retained.

Figure 7:
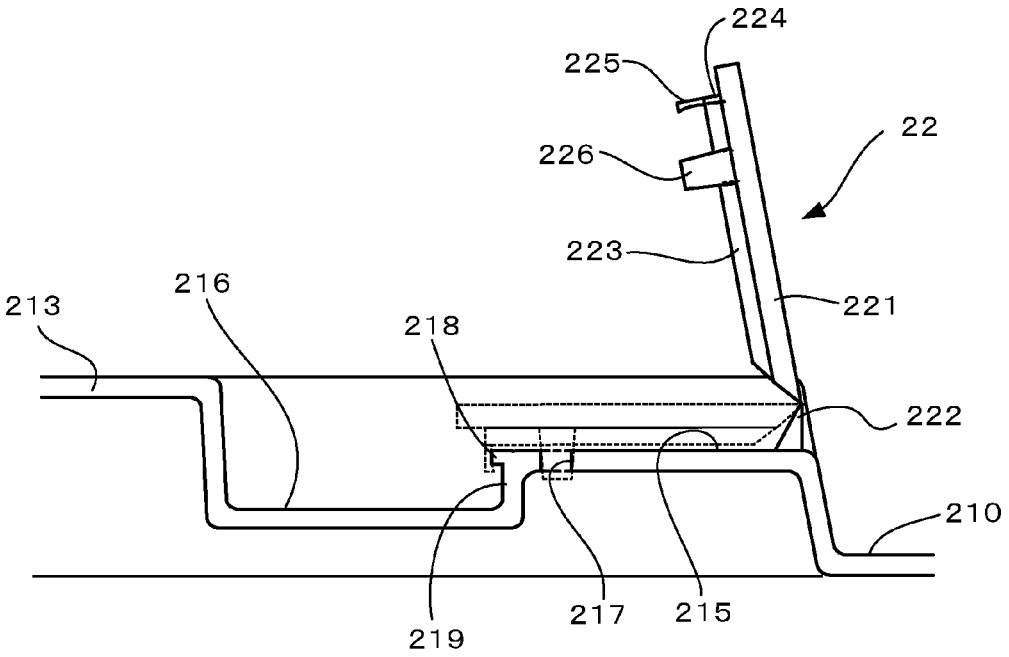
FIG. 7 is a cross-sectional view of the flap and its surroundings.
Figure 8:
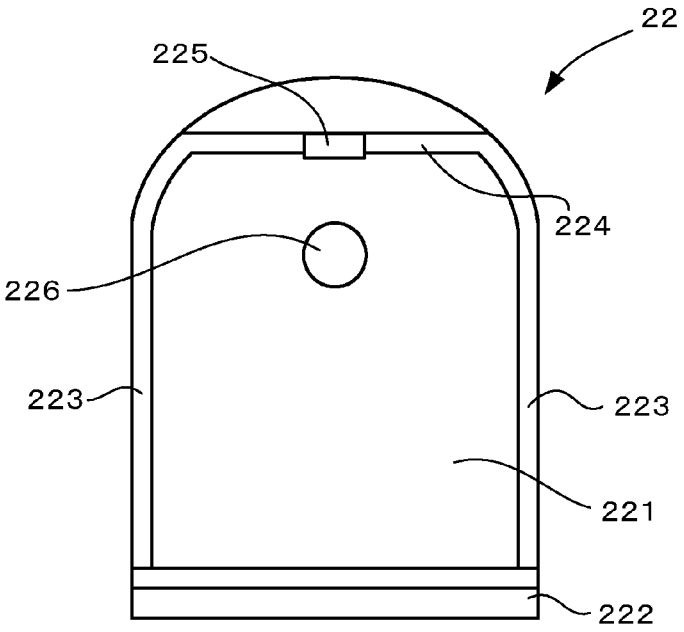
FIG. 8 is a plan view obtained as the flap is viewed from the lower surface side.

Next, the flap 22 will now be described in detail with reference to FIGS. 7 and 8. FIG. 7 is a cross-sectional view of the flap and its surroundings, and FIG. 8 is a plan view of the flap as viewed from the lower surface side. The flap 22 has a plate-like base 221 with a rectangular shape as viewed from above, and the base 221 is integrally attached to the first end side of the first depression 215 via a hinge 222. The width of the base 221 is slightly smaller than the width of the first depression 215, and the base 221 extends in the longitudinal direction so as to slightly project toward the second depression 216 from the edge on the second end side of the first depression 215. The second end side of the base 221 is rounded, and a portion of this rounded part projects from the first depression 215 toward the second depression 216. Side ribs 223 extending in the longitudinal direction (the first direction) are provided along the respective edges in the width direction on the lower surface of the base 221. Both side ribs 223 extend close to the border between the first depression 215 and the second depression 216 where the side ribs 223 are connected to a transverse rib 224 extending in the width direction (the second direction). The transverse rib 224 is provided with an L-shaped first latch (first latching part) 225 that extends downward. As will be described in detail below, the first latch 225 is configured to engage with a second latch (second latching part) 218 that projects toward the second end side from the upper end of the step 219 located at the border between the first depression 215 and the second depression 216. The lower surface of the base 221 is provided with a projection 226 that is disposed so as to be surrounded by the three ribs 223 and 224 and that fits in the air hole 217 of the body part 21. The projection 226 is formed in a cylindrical shape and formed such that the diameter becomes smaller toward the tip. More specifically, the diameter of the tip of the projection 226 is smaller than the inner diameter of the air hole 217, but the diameter becomes greater toward the base 221 side, and the diameter near the halfway point is greater than the inner diameter of the air hole 217.

The hinge 222 of the flap 22 is configured with a thin member that is formed integrally with the base 221. More specifically, as shown in FIG. 7, when the flap 22 is raised upright, the hinge 222 forms a plane that is in continuous with the base 221 on the upper surface side of the flap 22 and, on the other hand, forms a depression on the lower surface side of the flap 22, and thus the hinge 222 that is thinner than the base 221 is formed.

Figure 9:
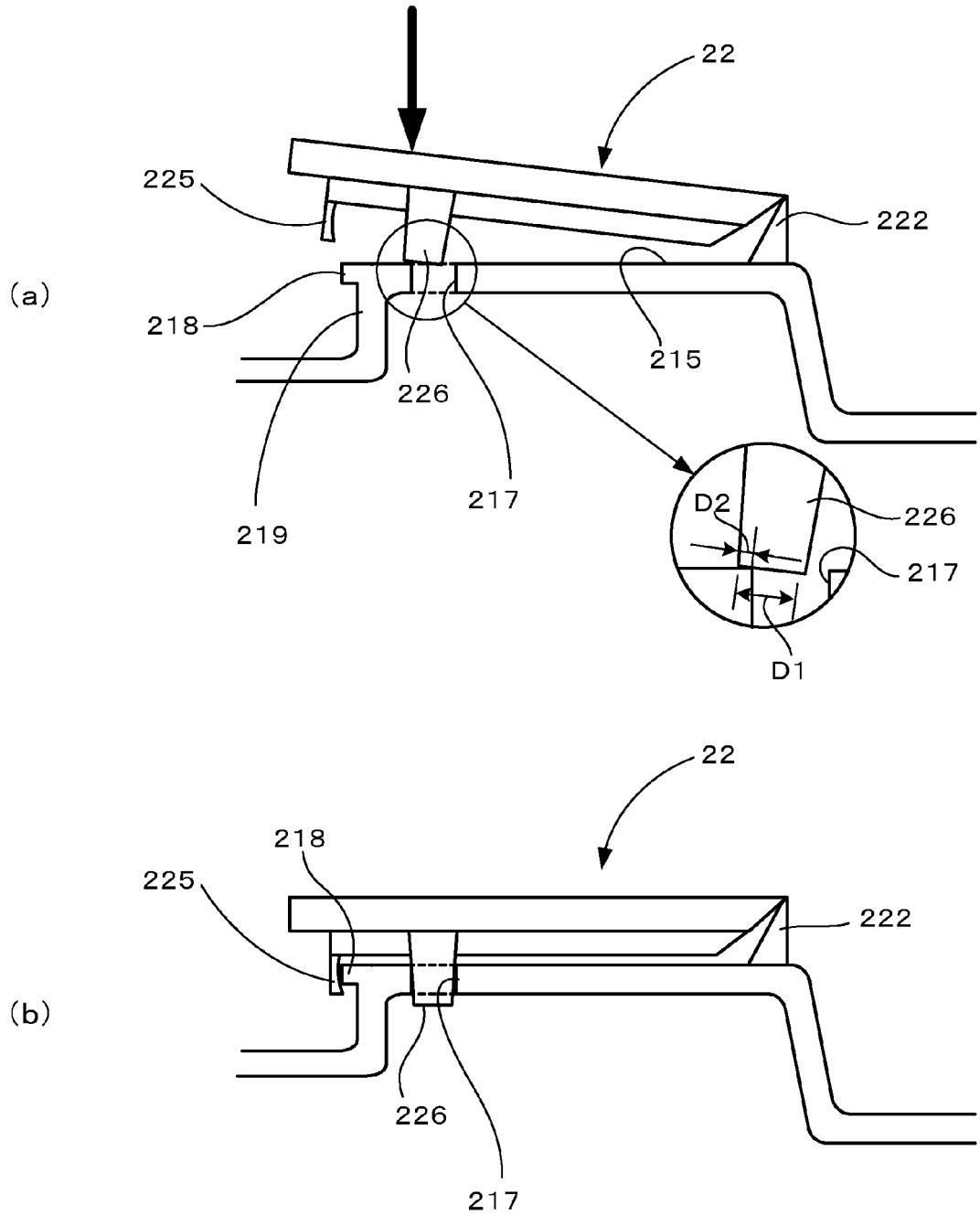
FIG. 9 is a cross-sectional view showing a manner of dosing an air hole.

Next, the positional relationship between the projection 226 of the flap 22 and the air hole 217 of the body part 21 will now be described in reference to FIG. 9. FIG. 9 is a cross-sectional view showing a manner of closing the air hole. When the flap 22 in an upright state (an example of the second position, see FIG. 7) is closed so as to be parallel with the first depression 215 (the first position), the projection 226 of the flap 22 does not directly fit in the air hole 217, but as shown in FIG. 9(*a*), first, the second end side of the tip of the projection 226 comes into contact with the circumferential edge on the second end side of the air hole 217. At this time, it is preferable that a region (the length in the diameter direction) D2 of the tip of the projection 226 that comes into contact with the circumferential edge of the air hole 217 is, for example, about 10 to about 20% of a diameter D1 of the tip of the projection 226. When the flap 22 in this state is pressed downward, the flap 22 is elastically deformed, and the projection 226 while moving toward the first end side fits in the air hole 217, and the first latch 225 and the second latch 218 engage as well. At this time, as the projection 226 fits in the air hole 217, the base 221 is slightly pulled toward the first end side, and thus the first latch 225 is also pulled toward the second latch 218 side. Accordingly, the engagement of the latches 225 and 218 is strengthened. Note that the elastic deformation of the flap 22 herein means that elastic deformation occurs in any portion of the flap 22. That is, the projection 226 may be configured to be moved toward the first end side and fitted in the air hole 227 due to the deflection of the base 221, hinge 222, or projection 226.

Next, the clasps provided on the body part 21 will now be described. As shown in FIG. 4, the first clasp 23 is for fixing to the grip 114 of the container body 1, is formed in a plate shape, and is attached to each end in the longitudinal direction of the body part 21 via a thin hinge 231. The hinge 231 allows the first clasp 23 to be folded downward. The first clasp 23 is provided with a through-hole 232 that extends in the width direction, and the grip 114 shown in FIGS. 2 and 3 fits in this through-hole 232. Once the grip 114 fits in the through-hole 232, the projections 115 that extend downward engage with the lower edge of the through-hole 232, thereby preventing the grip 114 from being detached from the through-hole 232.

Furthermore, as shown in FIG. 5, the second clasp 24 is for fixing to the roll-back part 111 of the container body 1, and is formed in a plate shape extending in the longitudinal direction. The second clasp 24 is attached to each end in the width direction of the body part 21 via a pair of thin hinges 241 that are disposed at a specific distance apart. The hinges 241 allow the second clasp 24 to be folded downward. The lower surface of the second clasp 24 is provided with a pair of latching projections 242 that are disposed at a specific distance apart in the longitudinal direction. The latching projections 242 are each formed so as to have an L-shaped cross-section and configured such that the bent portion at the tip engages from below with the roll-back part 111 of the container body 1.

3. Manner of Using Container

Next, a manner of using of the container will now be described. First, food is placed in the container body 1, and the lid 2 is attached. At this time, the lid 2 is attached such that the upper end 11 of the container body 1 fits in the circumferential groove 212 of the lid 2. Accordingly, the upper end 11 of the container body 1 comes into contact with the sealing member 3 accommodated in the circumferential groove 212. Then, pressing the lid 2 toward the container body 1 side against the elastic force of the sealing member 3 pushes the sealing member 3 against the upper end 11 of the container body 1, thus increases the degree of adhesion between the sealing member 3 and the upper end 11, and causes the sealing member 3 to deform in the width direction. As described above, the width of the circumferential groove 212 is greater than the width of the sealing member 3 to which a load is not applied, and therefore, when the sealing member 3 is pressed, the width of the sealing member 3 becomes greater over the width direction of the circumferential groove 212, and accordingly, the area of contact between the circumferential groove 212 and the sealing member 3 increases. In this way, the degree of adhesion between the circumferential groove 212, the sealing member 3, and the upper end 11 of the container body 1 is enhanced, thereby making it possible to reliably prevent food leakage from the container body 1.

After the lid 2 is pressed down to some extent, the clasps 23 and 24 are folded downward. That is, the first clasps 23 are folded so that the grips 114 enter the through-holes 232. Also, the second clasps 24 are folded in the same manner so that the latching projections 242 engage with the lower end of the roll-back part 11 of the container body 1. Then, removing the hand from the lid 2 allows the elastic force of the sealing member 3 to act against the lid 2 and the container body 1. Accordingly, force acts such that the through-holes 232 of the first clasps 23 and the grips 114 push against each other. Similarly, force acts such that the latching projections 242 of the second clasps 24 and the roll-back part 111 push against each other. In this way, the clasps 23 and 24 are firmly fixed to the container body 1.

Then, when storing the food in an airtight state, the air hole 217 is closed. As stated above, when closing the flap 22, first, part of the tip of the projection 226 comes into contact with the circumferential edge on the second end side of the air hole 217. Then, pressing the flap 22 further downward causes the flap 22 to elastically deform, and thus the projection 226 moves toward the first end side and fits in the air hole 217. At the same time, the first latch 225 and the second latch 218 engage with each other, and the flap 22 is fixed. In this way, the air hole 217 is closed by the projection 226, thus making it possible to store food in an airtight state. On the other hand, when heating the accommodated food in a microwave oven, the flap 22 is pulled up to detach the projection 226 from the air hole 217. When the container in this state is placed in a microwave oven and heated, steam inside the container is suitably released, thus making it possible to heat the food while the food is protected from being excessively steamed or dried. After microwave heating, the container body 1 without the lid 2 can be carried by holding the grips 114 by hand. That is, the side surface and the bottom surface of the container body 1 after being heated is hot, but the grips 114 are less hot.

4. Features of Container

As described above, according to this embodiment, when the flap 22 travels to the dosed position (first position), the projection 226 comes into contact with the circumferential edge on the second end side of the opening of the air hole 217, and then pressing down the flap 22 causes the projection 226 to fit in the air hole 217 as the flap 22 elastically deforms. Thus, the projection 226 under the elastic force adheres to the inner wall surface of the air hole 217, thus making it possible to enhance the adhesion between the inner wall surface of the air hole 217 and the projection 226 and to enhance the airtightness of the container. At this time, the flap 22 is pulled toward the first end side as the projection 226 fits in the air hole 217, and thus the first and second latches 225 and 218 are tightly engaged so as to push against each other. Therefore, the state of engagement of the latches 225 and 218 is strengthened, and the flap 22 can be firmly retained in the dosed state.

Moreover, since the projection 226 is tapered such that the diameter becomes smaller toward the tip side from the flap 22, the gap between the projection 226 and the air hole 217 decreases as the projection 226 enters the air hole 217, thus making it possible to fit the projection 226 in the air hole 217 so as to eventually achieve a no-gap state. It is also advantageous in that the projection 226 can smoothly fit in the air hole 217.

As described above, the width 11 of the circumferential groove 212 of the lid 2 is greater than the width t2 of the upper end surface 112 of the container body 1, and therefore, even when at least one of the container body 1 and the lid 2 is deformed by, for example, being heated in a microwave oven, such deformation is accommodated, and the circumferential groove 212 can receive the upper end surface 112 of the container body 1. Also, configuring the width t1 of the circumferential groove 212 of the lid 2 to be greater than the width t3 of the sealing member 3 to which a load is not applied makes it easy to fit the sealing member 3 in the circumferential groove 212 during assembly, thus greatly enhancing production efficiency.

5. Modifications

Figure 10:
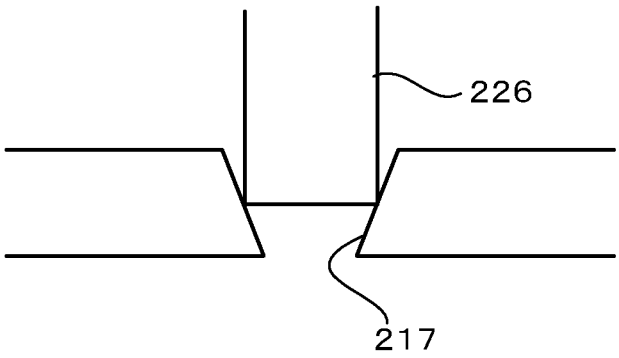
FIG. 10 is a cross-sectional view showing a shape relationship between a projection and an air hole.
Figure 10:
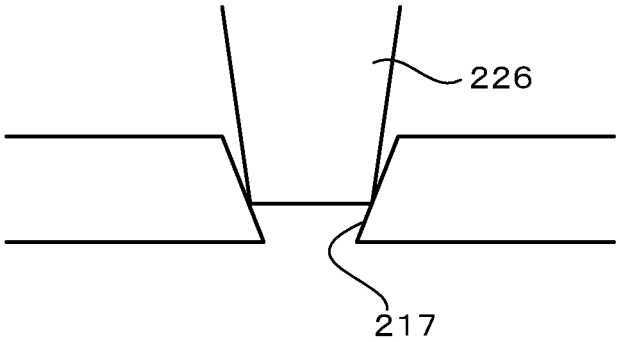
Figure 10:
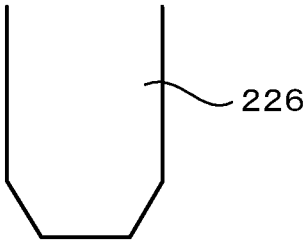

An embodiment of the present invention has been described above, but the present invention is not limited to the foregoing embodiment, and various changes can be made without departing from the gist of the present invention. For example, in the foregoing embodiment, the projection 226 is tapered and the diameter becomes smaller toward the tip, but the present invention is not limited to this embodiment. For example, as shown in FIG. 10(*a*), it is possible to form the projection 226 so as to have a cylindrical shape with a constant diameter and the air hole 217 so as to have a diameter that becomes smaller from the upper surface toward the lower surface of the body part 21. Also, as shown in FIG. 10(*b*), the projection 226 and the inner wall surface of the air hole 217 may be both inclined. Also, as shown in FIG. 10(*c*), it is possible that only the portion in the vicinity of the tip of the projection 226 is tapered. In addition, the projection 226 may have a cross-sectional shape other than a circle, for example, a polygonal cross-sectional shape. In such a case, the air hole 217 needs to have a polygonal shape accordingly.

Moreover, the manner of contact between the projection 226 and the circumferential edge of the air hole 217 before the projection 226 fits in the air hole 217 is also not limited to that described above. For example, as shown in FIG. 11, the projection 226 may come into contact with the circumferential edge of the air hole 217 in the following manner: the tip surface (portion that is not a tapered surface) of the projection 226 comes into contact with the circumferential edge of the air hole 217 (FIG. 11(*a*)), the tip surface of the projection 226 comes into contact with the inner wall surface of the air hole 217 (FIG. 11(*b*)), the tapered surface of the projection 226 comes into contact with the circumferential edge of the air hole 217 (FIG. 11(*c*)), or the tapered surface of projection 226 comes into contact with the inner wall surface of the air hole

Figure 11:
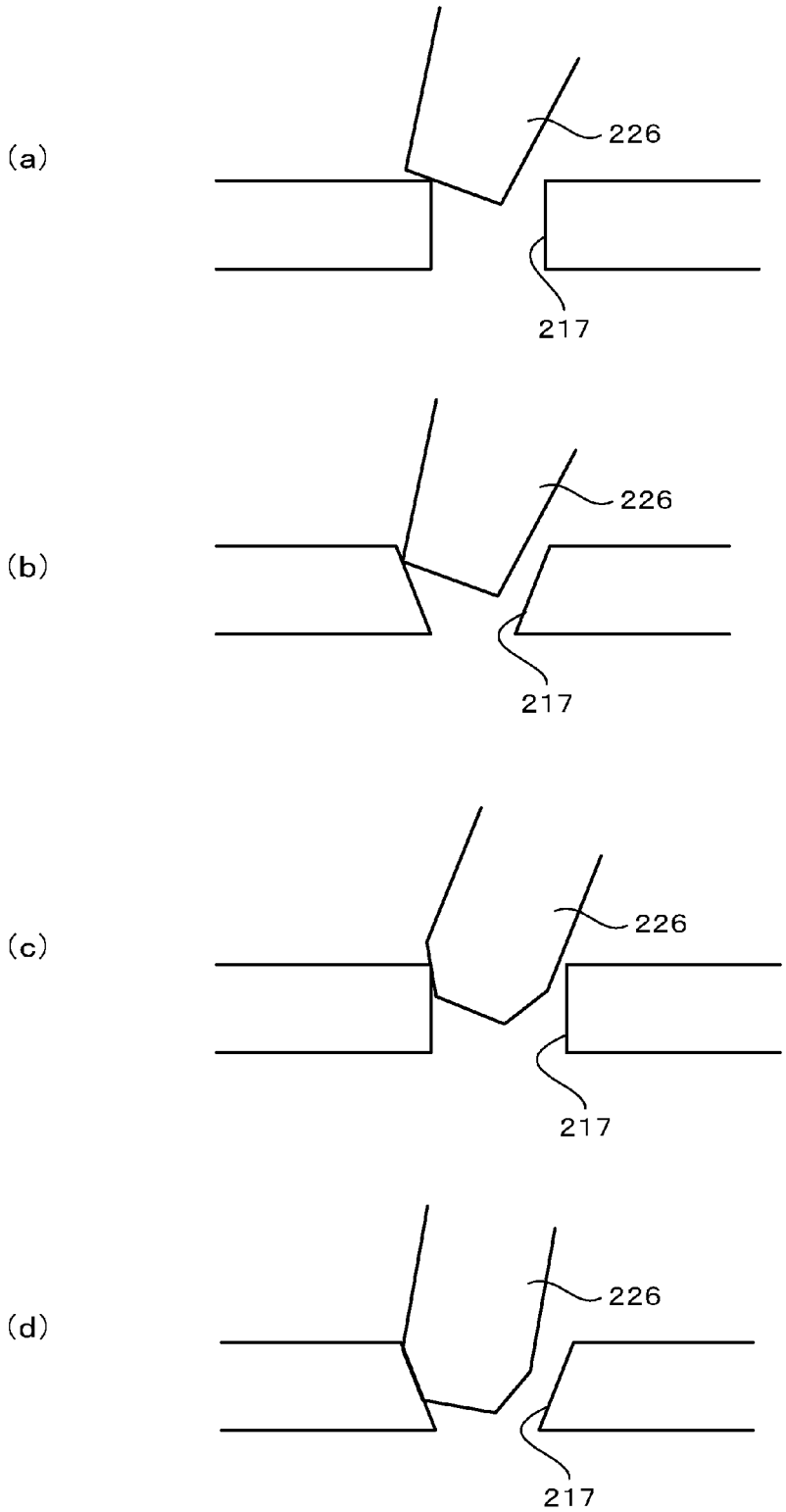
FIG. 11 is a cross-sectional view showing a positional relationship between the projection and the air hole.

217 (FIG. 11(*d*)). That is, the projection 226 may come into contact with the circumferential edge part, i.e., either the circumferential edge or the inner wall surface, of the air hole 217, or in other words, the projection 226 and the air hole 217 may be in such a positional relationship that the projection 226 does not fit in the air hole 217 without elastic deformation of the flap 22.

The manner of engagement of the first and second latches (latching parts) are not particularly limited as long as the first and second latches reach an engaged state. For example, the first latch 225 may be L-shaped or curved. Also, the second latch 218 is provided so as to project from the step 219 located at the border between the first depression 215 and the second depression 216, but it is possible to, for example, form a depression as the second latching part in the step 219 such that the projection of the first latch 225 (the tip of the L-shaped latch) facing the hinge 222 side fits in this depression.

In the foregoing embodiment, the flap 22 is provided on the first end side of the central bulge 213, but the position the flap 22 is not particularly limited, and the flap 22 may be provided anywhere on the body part 21. For example, it is possible that the hinge 222 of the flap 22 is provided on the second end side such that the tip of the flap 22 faces the first end side of the central bulge 213. At this time, providing the second latch 218 on the edge on the first end side of the central bulge 213 makes it possible to retain the flap 22 in a closed state.

In the foregoing embodiment, the adhesion between the container body 1 and the lid 2 is enhanced by providing the sealing member 3, but the present invention is not limited to this embodiment, and the upper end 11 of the container body 1 and the circumferential groove 212 of the lid 2 may be configured to have such dimensions that the upper end 11 and the circumferential groove 212 tightly adhere to each other without providing the sealing member 3.

In the foregoing embodiment, the container is used as a food container, but it can also be used for various articles. That is, the lid 2 and the container according to the present invention are applicable to any article that needs to be in an airtight state and an aerated state.

What is claimed is:

1. A lid for attachment to a container body that has an opening in an upper part, comprising:

a body part that closes the opening of the container body and has an air hole for communication with the inside of the container body, and a flap that includes a base, a hinge that is provided on a first end of the base and connected to the body part, and a projection that is provided on a second end side of the base and fitted in the air hole so as to be capable of sealing the air hole, and is configured to be swingable around the hinge between a first position in which the projection fits in the air hole and a second position in which the air hole is open, wherein the body part and the flap are integrally formed from resin, and wherein, the projection includes a surface on a distal tip of the projection, the surface being substantially parallel to the second end side of the base, and as the flap swings from the second position to the first position, the surface on the distal tip of the projection comes into contact with a circumferential edge of the air hole on a side opposite the hinge, the projection then, while moving toward the hinge side, fits into the air hole as the flap elastically deforms in response to downward pressure.

2. The lid according to claim 1, wherein a diameter of a tip of the projection is smaller than an inner diameter of the air hole, a diameter of the projection becomes greater toward a side of the base, and a diameter at a halfway point of the projection is greater than the inner diameter of the air hole.

3. The lid according to claim 1, wherein the flap further includes a first latching part that is attached to the second end side of the base, the body part further includes a second latching part that can engage with a portion of the first latch facing the hinge side, and the first latching part and the second latching part engage when the flap is in the first position.

4. The lid according to claim 1, wherein the flap further includes at least one first rib that extends from the first end side toward the second end side of the base.

5. The lid according to claim 1, wherein the second end of the base of the flap is rounded, and the base is provided with a second rib that extends in a second direction that is perpendicular to a first direction extending from the first end toward the second end, at a predetermined distance away from the second end toward the first end side.

6. A container comprising a container body that has an opening in an upper part and the lid according to claim 1 that is for attachment to the container body.

* * * * *